US005140833A

United States Patent [19]

Whalen

[11] Patent Number: 5,140,833

[45] Date of Patent: Aug. 25, 1992

[54] SECURITY AND STORAGE ENCLOSURE FOR PORTABLE COOLER

[76] Inventor: Michael T. Whalen, 5766 Windsong SE. Unit 301, Stuart, Fla. 34997

[21] Appl. No.: 704,266

[22] Filed: May 22, 1991

[51] Int. Cl.[5] ..... A45C 11/20; A45C 13/18

[52] U.S. Cl. ..... 62/457.7; 150/154; 190/101; 190/110

[58] Field of Search ..... 62/457.1, 457.2, 457.7, 62/371, 372; 190/102, 108, 110, 101, 903; 150/154, 901

[56] References Cited

U.S. PATENT DOCUMENTS

| | | | |
|---|---|---|---|
| 3,640,420 | 2/1972 | Carter et al. | 220/9 R |
| 3,837,447 | 9/1974 | Honan | 190/52 |
| 3,965,706 | 6/1976 | Davis | 70/68 |
| 4,375,828 | 3/1983 | Biddison | 62/371 X |
| 4,436,214 | 3/1984 | Henderson | 220/475 X |
| 4,640,392 | 2/1987 | Decker, Jr. et al. | 190/108 |
| 4,724,681 | 2/1988 | Bartholomew | 62/239 |
| 4,747,490 | 5/1988 | Smith | 190/102 X |
| 4,907,716 | 3/1990 | Wankel et al. | 220/326 |
| 5,005,676 | 4/1991 | Hjelle | 190/110 |

*Primary Examiner*—Albert J. Makay
*Assistant Examiner*—William C. Doerrler
*Attorney, Agent, or Firm*—Malin, Haley, McHale, DiMaggio & Crosby

[57] ABSTRACT

An enclosure for providing security and extra storage space for a portable cooler comprised of a rugged non-tearable fabric enclosure having an opening along one end to permit insertion or removal of the cooler, and a separate security cable that can be attached to the enclosure to prevent theft of the cooler by locking the cable around a picnic table leg or portable lawn chair. The enclosure includes storage pockets that can house additional items that can not be placed within the cooler such as a portable television, sunglasses, such that all recreational paraphernalia can be carried as one unit to the beach or picnic area.

12 Claims, 3 Drawing Sheets

SECURITY AND STORAGE ENCLOSURE FOR PORTABLE COOLER

BACKGROUND OF THE INVENTION

1. Field of the Invention

This invention relates generally to a security and article enclosure for use with a portable cooler or ice chest, and in particular, to a heavy duty enclosure for use with a portable cooler that can safeguard items in the cooler from unauthorized removal, provide secured article storage and provide for secure attachments of the cooler and enclosure to other types of beach articles such as beach chairs and the like.

2. Description of the Prior Art

Portable coolers which house ice, beverages, foodstuffs and the like are commonly used, especially at picnics or beach areas throughout the United States. Typically, the cooler is made of a durable plastic, is rectangularly shaped, has a removable lid and a carrying handle on top of the lid. One of the problems with the use of portable coolers is that in public areas, articles can quickly and easily be removed from the cooler by unauthorized persons. Also, since coolers are light weight and quite small, removal of the entire cooler is often possible. It is also desirable to take hand held items to the beach or picnic areas that can be exposed to the inside of the cooler such as a portable radio, television or other recreational gear which must be carried by the user along with the cooler. The present invention provides for a security enclosure for the cooler that also includes storage space for additional items such as radio and recreational items which are not exposed to the inside of the cooler but can also be secured from theft along with the portable cooler. The security enclosure in accordance with the present invention also provides a cable locking device that allows the entire enclosure and cooler to be secured to other large items such as a picnic table or beach chair to prevent unauthorized removal of the entire cooler. A cooler latch has been shown in the prior art such as in U.S Pat. No. 4,904,007 issued Feb. 27, 1990 to Woodruff which has a releasable latch for use with a picnic cooler. Portable insulated containers for carrying beverage cans and the like are shown in U.S Pat. No. 4,375,828 issued to Biddison, Mar. 8, 1983. The problem of providing additional storage areas when going to places like the beach or picnic is discussed in U.S. Pat. No. 4,667,484 issued to Tarozzi on May 26, 1987 which shows a portable cooler having a lid with a cavity for carrying additional articles such as sunglasses or the like. None of the coolers shown in the prior art show a security enclosure that also provides additional pockets for carrying numerous different types of items, for security to prevent removal of articles from within the cooler or in the storage pockets and which aid to prevent theft of the entire cooler by providing a locking cable to attach the cooler to other immobile objects.

BRIEF SUMMARY OF THE INVENTION

A security enclosure for a portable cooler or ice constructed from a durable, rugged, hard to tear woven fabric and formed in the shape of a five sided polyhedron, with the sides of the rectangular panels tightly together to a floor panel. A pair of adjacent side wall panels are separable by a fastener closure such as a first zipper or VELCRO along one corner of the enclosure to allow the installation or removal of the cooler from the enclosure. The enclosure has an open top that is smaller than the lid of the cooler and permits the cooler handle to protrude upward above the enclosure.

The exterior walls of the fabric enclosure may also include one or more rugged fabric storage pockets fastened to the outside of the enclosure side wall panel and having a second zipper fastener along the top of the enclosure for opening and closing each pocket for access. The second zipper may be provided around the entire top of the enclosure to secure all side pockets.

The fabric enclosure and pockets can be locked closed by slotted plates firmly affixed to both zipper mechanisms. Each plate is engageable with a semicircular fastener (eye) permanently affixed to one panel of the enclosure near the termination point of both zippers when the entire enclosure is in a closed condition. For example, the first zipper is mounted vertically at one corner of the enclosure from top to bottom to fasten the corner closed. The first zipper is in a locked or fastened condition with the zipper activating mechanism at the top of the enclosure. Adjacent the termination point of the first zipper is the semicircular rigid metalic eye fastened securely to the panel. The slotted plates attached to the first and second zippers are engaged to the eye fastener. A cable may be inserted through the eye with the zipper mechanism plates below, thereby preventing either zipper from being moved when the locking cable is in position. The locking cable may be similar to those found in locking bicycles, and is constructed of a metal cable having a manual locking mechanism disposed at each end. The cable locking mechanism typically has a male end and female end and often has a circular pair of combination number plates that are rotated to specific numerical locations to unlock one end of the cable from the opposite end. In this condition, the cable may be secured around some other object such as a picnic table, lawn chair, or the like to prevent removal of the entire cooler and enclosure while at the same time locking both zippers closed.

The second zipper and locking plate will be used about the top of the enclosure to fasten closed one or more pockets arranged around the outside of the enclosure. The second zipper may be disposed around the entire top of the enclosure such that the zipper activating mechanism when the pockets are closed, the second zipper mechanism is also at its termination point adjacent the locking eye mechanism. Therefore both the first zipper locking plate and the second zipper locking plate can be disposed over the eye and the locking cable therethrough firmly insuring that both zippers are fastened closed and in a locked condition whenever the locking cable is disposed through the eye. The cable can also serve as a shoulder strap.

It is an object of this invention to provide an improved security enclosure for a portable cooler or ice chest.

It is another object of this invention to provide an enclosure for a portable cooler that provides both security and extra storage space for carrying additional articles not suitable for placement in the cooler.

And yet still another object of this invention is to provide a secure enclosure for a portable cooler that itself can be attached or fixed in a locked position to an adjacent object to prevent theft of the entire enclosure while at the same time securing the interior contents of the cooler from unauthorized removal.

PREFERRED EMBODIMENT OF THE INVENTION

Figure 1:
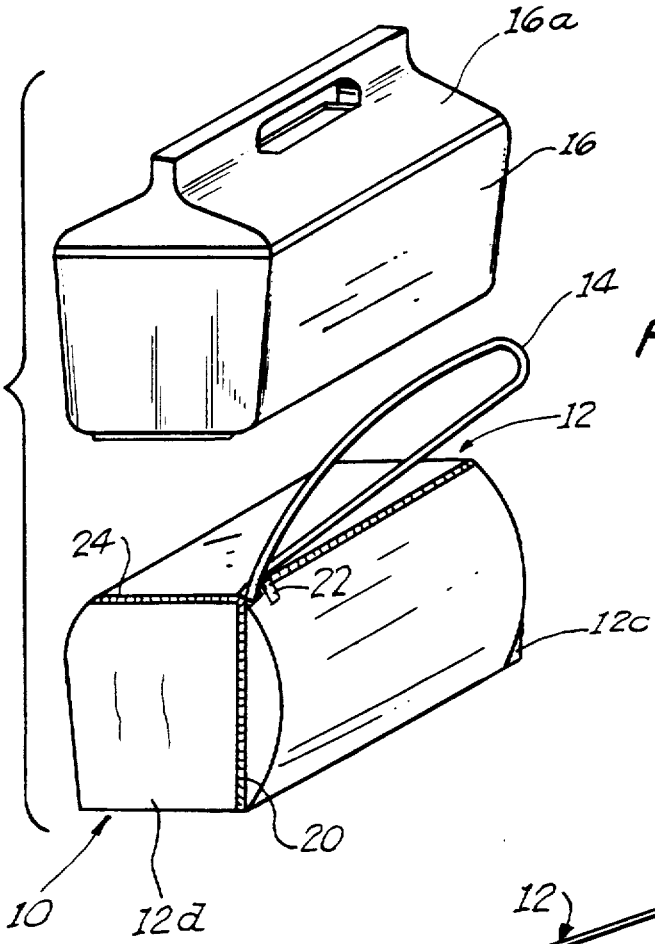
FIG. 1 shows an exploded perspective view of an enclosure in accordance with the present invention and a typical cooler.

Referring now to the drawings and in particular, FIG. 1, the present invention is shown generally 10 comprising a fabric enclosure 12 made up of plurality of panels which could all be cut from a single piece of fabric to provide substantially a rectangular shape and sized to enclose a conventional food and beverage cooler 16. The portable cooler 16 can be of the type known under the Trademark IGLOO, or other conventional cooler.

The enclosure 10 includes a zipper 20 that fastens one side panel **12*c* and one end panel 12*d* together along one corner from the bottom of the enclosure to the top of the enclosure. This allows the enclosure to be opened along one corner to receive or remove the portable cooler. A second zipper 24 is disposed around the upper opening of the enclosure 12 and is used to fasten storage pocket 26 which may be disposed on one or more of the side panels of the enclosure. A locking cable 14 is attached to both zipper mechanisms and to a locking device 22** which is described in greater detail below.

The purpose of the enclosure 10 is to encompass a substantial portion of portable cooler 16 so that the lid **16*a* on cooler 16 cannot be removed with the enclosure locked in place. This will prevent the unauthorized removal of any items disposed within the cooler 16**.

Another important feature of enclosure 10 is the locking cable 14 which also allows the enclosure and the cooler secured therein to be secured to a more stable or permanent object so as a picnic table or lawn chair making its entire removal impossible or conspicuously obvious.

The fabric material used for enclosure 12 is a very durable, rip-proof, tear-proof and cut-proof material such as kevlar or other known very strong fabric like material such that someone could not easily cut or tear away security enclosure.

Figure 2:
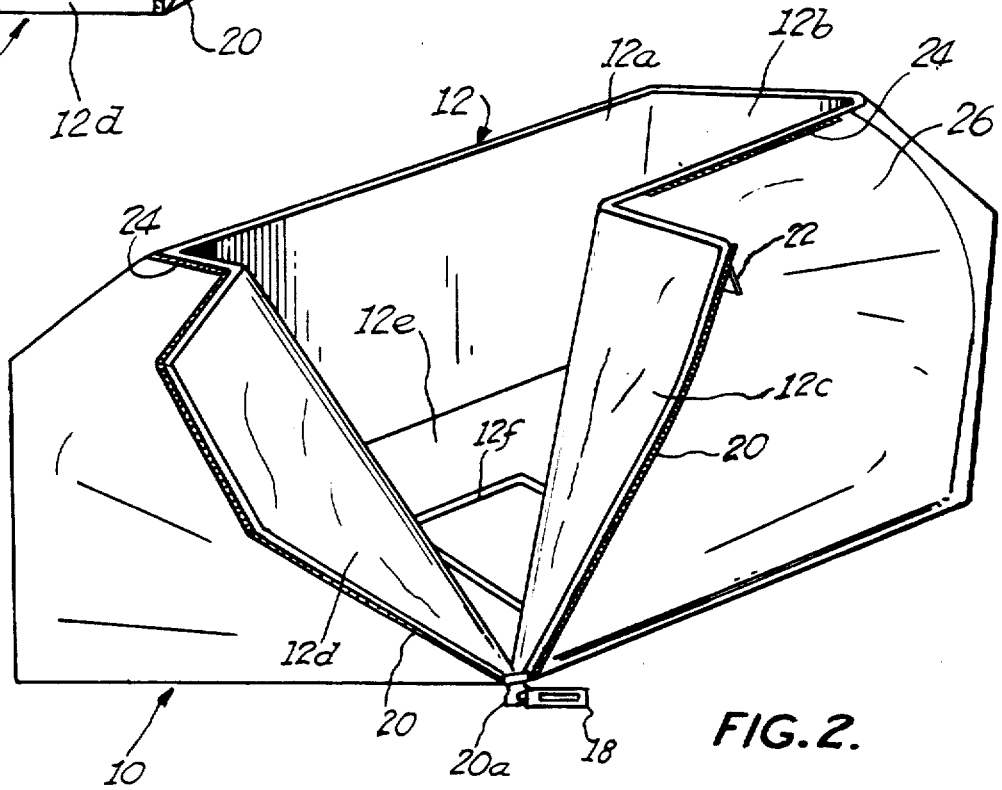
FIG. 2 shows a perspective view of the enclosure in accordance with the present invention without the locking cable and with one corner of the enclosure open that allows for insertion or removal of a portable cooler.

Referring now to FIG. 2, the invention 10 is shown with one end panel **12*d* and one side panel 12*c* disconnected. The zipper is in the unfastened or open position with the zipper activating mechanism 20*a* near bottom 12*e*. The enclosure 10 is comprised of a plurality panels 12*a*, 12*b*, 12*c*, 12*d* coupled together (except at zipper 20) and to a bottom panel 12*e* which itself may have an opening 12*f*. All of the corners and edges and panels are tightly and firmly sewn together except for the edges between panels 12*c* and 12*d* which includes the first zipper fastener 20**. Other fasteners could be used such as VELCRO along the corner edge.

The second zipper 24 around the top of the device is used to open and close a storage pocket 26 mounted on one side of panel **12*c*. Each of panels of the enclosure could have a separate storage pocket such as a pocket 26** on its exterior side. Each pocket is sized to receive articles that would not be placed in the portable cooler such as a small hand-held radio or television set, sunglasss or other recreational articles.

Figure 3:
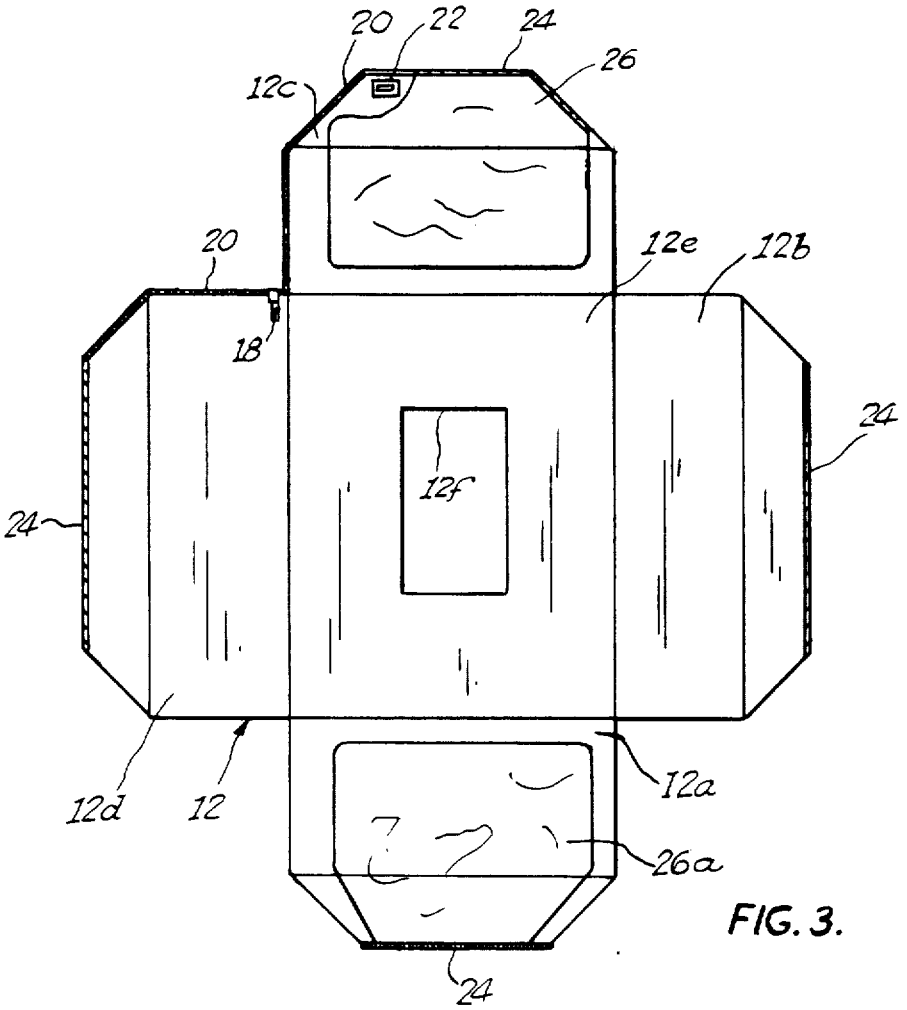
FIG. 3 shows a plan view in which the enclosure pattern disposed in a flat disposition to show the overall pattern used in construction of the enclosure in accordance with the present invention.

FIG. 3 shows an entire piece of fabric in a plan view constituting the enclosure 12 and in a pattern that could be used for the construction of the invention. The enclosure is basically comprised of the fabric **12*a*, 12*b*, 12*c*, 12*d* which are essentially rectangular with a trapezoidal upper portion all of which is sewn together except along the edges containing zipper 20. The top edge of the enclosure forms an opening that permits the handle of a typical cooler to produce out for easy carriage without allowing the top lid of the cooler to be removed from the enclosure when its in the locked condition. The bottom panel 12*e* includes a rectangular opening 12*f* for cleaning purposes. A pair of pockets 26 and 26*a* are shown attached to side panels 12*a* and 12*c*. As stated above, all four sides could have storage pockets such as pocket 26 in which the encompassing zipper 24** would provide for opening or closure of the pocket.

Figure 4:
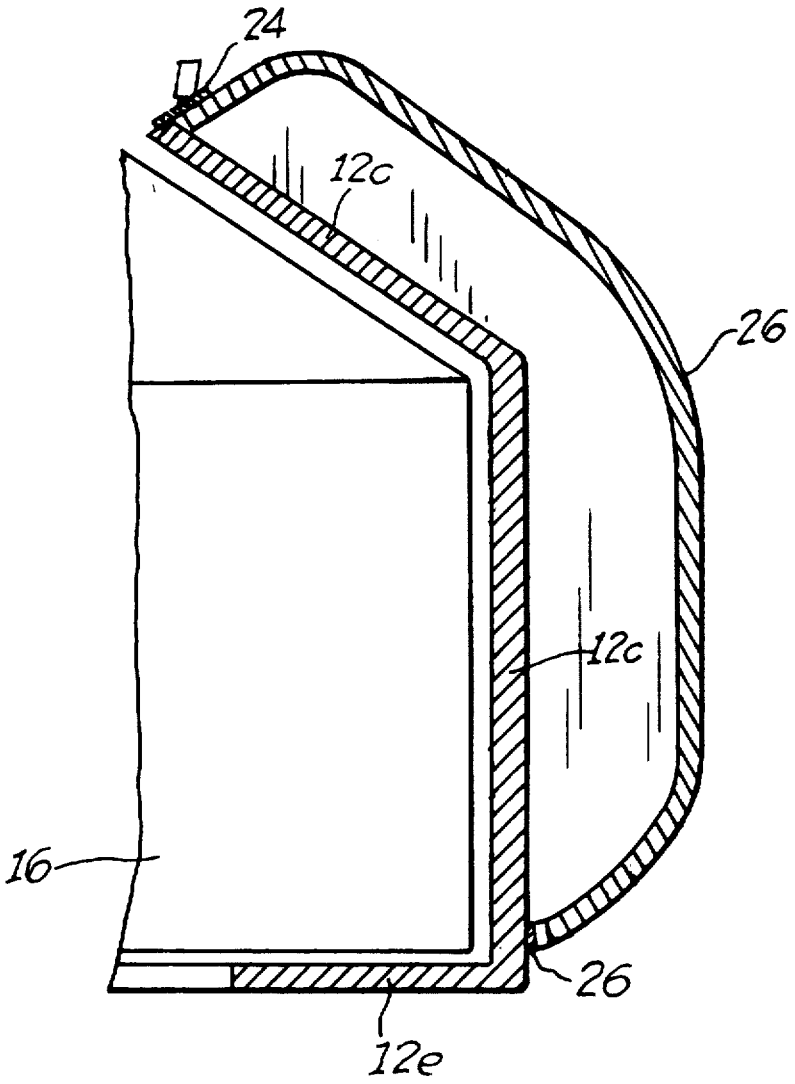
FIG. 4 shows a side elevational view of a portion of the enclosure and a pocket attached thereto in accordance with the present invention.

FIG. 4 shows a side view of one panel **12*c* which due to its shape and flexibility as a fabric allows it to confirm to the outer housing of portable cooler 16. It also shows an additional fabric panel 26 which constitutes the pocket fastened at 26*b* which is sewn around its edge to make it securely attached to panel 12*c* while at the top being attached by a zipper 24 running along the edge of the pocket 26. The top panel is connected by zipper 24 which connects and fastens the pockets 26 to the outer panel 12*c***.

Figure 5:
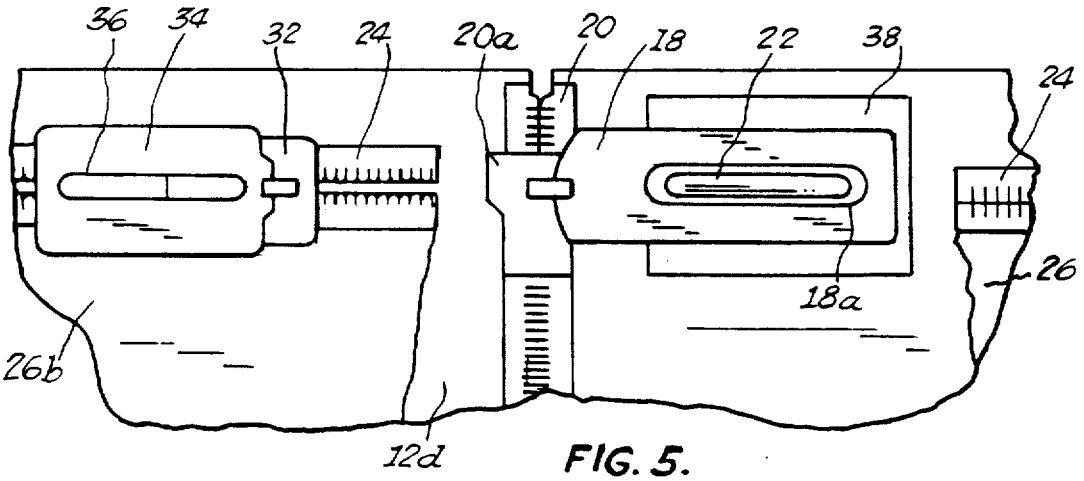
FIG. 5 shows a top plan view of a segment of the present invention including the zipper locking mechanism.

Referring now to FIG. 5, the zipper and cable locking mechanisms in accordance with the present invention is shown. The purpose of the zipper and cable locking mechanisms is to insure that the zippers (the edge panel and for the pockets) can be locked securely closed while providing at the same time a cable that allows the entire unit to be attached to a rigid object such as a picnic table, lawn chairs or the like by the cable. As shown in FIG. 5, the zipper activating mechanism **20*a* has firmly attached thereto a plate 18 that has a slot 18*a* that fits over an eye 22 that is firmly mounted to fabric 12*c* by a rigid support 38 on each side of fabric 12*c* holding eye 22** in place.

Figure 6:
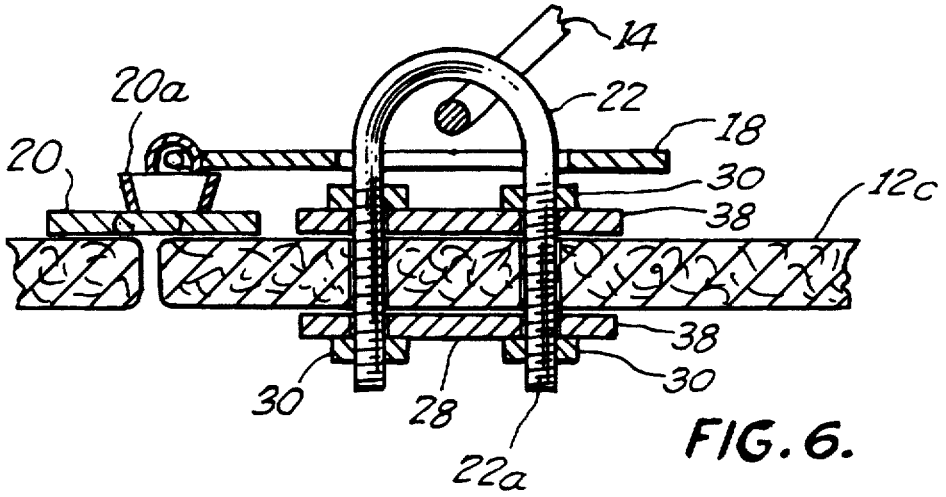
FIG. 6 shows a side elevational view of the locking mechanism shown in FIG. 5 partially cut away.

In addition, second zipper activating mechanism 32, which fastens the zipper 24 together includes a locking plate 34 having slot 36 which also can be used to engage eye 22 at the same time the plate 18 is engaged so that both first zipper mechanism **20*a* and second zipper mechanism 32 can be firmly locked to eye 22. FIG. 6 shows plate 18 locked to eye 22. A metal cable 14 is disposed through eye 22 with the plate 18 positioned over the eye that plate 18 is firmly attached to the eye 22. Although not shown in FIG. 6, plate 34 would also be mounted over plate 18 so that both zippers can be locked simultaneously by cable 14. As shown in FIG. 6, the eye 22 is firmly attached to fabric 12*c* by metal plates 38 and bolts 30 which fit to threaded portions of eye 22. The cable 14** is formed in a loop with a locking mechanism for attachment at each end of the cable around a larger object. Any suitable cable lock could be used with the cable including a key and lock that is secured at one end. The importance of the cable is to allow the entire enclosure to be secured to a rigid device such as a post, a picnic table, lawn chair or any object that would make it very conspicuous for someone to attempt to walk away with another object attached thereto with the cooler and enclosure.

Although the particular enclosure has been shown using cavlar kevlar material, other known very rugged fabrics could be used to provide for the enclosure. Also, VELCRO fasteners could be used where practical.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An enclosure for protecting and safeguarding the contents of a portable cooler and the cooler itself from unauthorized transport or theft, said portable cooler having a base and a lid, comprising:

a conformable enclosure sized and shaped to be received about a substantial portion of said base and a portion of said lid, such that when the enclosure is in place, the cooler lid cannot be removed from the base of the cooler;

means for opening said enclosure to permit removal or installation of said portable cooler from or into said enclosure; and means for locking said enclosure to prevent the opening of said enclosure.

2. A security enclosure in claim 1 wherein, said means for opening and locking said enclosure includes a first enclosure edge fastening means and a loop means for engaging said fastening means, said loop means connectible to said fastener for locking with a secure loop.

3. A security enclosure as in claim 1, wherein said enclosure includes at least one storage pocket attached to the outside of said enclosure 4. A security enclosure for a portable cooler as in claim 2, including:

said conformable enclosure is constructed of a rugged, non-tearable fabric, said fabric shaped to include four side panels substanially rectangular with trapezoidally shaped upper portions, said fabric enclosure being ruggedly sewed together except along one corner edge; and a zipper fastener disposed along the corner edge of said fabric enclosure joining adjacent side panels for an open and closed corner edge of said enclosure.

5. An enclosure as in claim 4, including:

an additional non-tearable fabric panel attached to the outside of one of said enclosure panels forming a storage pocket; and second zipper for opening and closing said storage pocket attached to said storage pocket and said enclosure.

6. A security enclosure as in claim 5, including:

means for locking said first zipper and second zipper in a closed position.

7. A security enclosure as in claim 6, including:

a cable locking means connected to said first and second zipper locking mechanisms, said cable locking means for locking said first and second zippers in a locked position and including a cable sized to permit said cable to be locked around an object in the form of a loop of the cable, and cable including its own locking mechanism to form a loop in a locked position.

8. An enclosure for protecting and safeguarding the contents of a portable cooler and the cooler itself from unathorized transport or theft, comprising:

a conformable enclosure sized and shaped to be received about a substantial portion of a portable cooler, having a base and a lid, such that when the enclosure is in place, the cooler lid cannot be removed from the base of the cooler, said conformable enclosure being constructed of a rugged, non-tearable fabric, said fabric shaped to include four side panels substantially rectangular with trapezoidally shaped upper portions, said fabric enclosure being ruggedly sewed together except along one corner edge;

means for opening said enclosure to permit removal or installation of said portable cooler from or into said enclosure;

means for locking said enclosure to prevent the opening of said enclosure; and a zipper fastener disposed along the corner edge of said fabric enclosure joining adjacent side panels for an open and closed corner edge of said enclosure;

wherein said means for opening and locking said enclosure includes a first enclosure edge fastening means and a loop means for engaging said fastening means, said loop means connectible to said fastener means for locking with a secure loop.

9. An enclosure as in claim 8, including:

an additional non-tearable fabric panel attached to the outside of one of said enclosure panels forming a storage pocket; and second zipper for opening and closing said storage pocket attached to said storage pocket and said enclosure.

10. A security enclosure as in claim 9, including means for locking said first zipper and said second zipper in a closed position.

11. A security enclosure as in claim 10, including a cable locking means for locking said first and second zippers in a locked position and including a cable sized to permit said cable to be locked around an onject in the form of a loop of the cable, said cable including its own locking mechanism to form a loop in a locked position.

12. An enclosure for protecting and safeguarding the contents of a portable cooler and the cooler itself from unauthorized transport or theft, comprising:

a conformable enclosure sized and shaped to be received about a substantial portion of a portable cooler, having a base and a lid, such that when the enclosure is in place, the cooler lid cannot be removed from the base of the cooler, said conformable enclosure is constructed of a rugged, non-tearable fabric, said fabric shaped to include four side panels substantially rectangular with trapezoidally shaped upper portions, said fabric enclosure being ruggedly sewed together except along one corner edge;

means for opening said enclosure to permit removal or installation of said portable cooler from or into said enclosure;

means for locking said enclosure to prevent the opening of said enclosure; and a zipper fastener disposed along the corner edge of said fabric enclosure joining adjacent side panels for an open and closed corner edge of said enclosure.

* * * * *